US007818884B2

(12) United States Patent
Royle et al.

(10) Patent No.: US 7,818,884 B2
(45) Date of Patent: Oct. 26, 2010

(54) SHAVING APPARATUS

(75) Inventors: Terence Gordon Royle, Oakley (GB); Oliver David Oglesby, Tadley (GB); Christopher John Stevens, Reading (GB)

(73) Assignee: The Gillette Company, Boston, MA (US)

( * ) Notice: Subject to any disclaimer, the term of this patent is extended or adjusted under 35 U.S.C. 154(b) by 138 days.

(21) Appl. No.: 11/571,061

(22) PCT Filed: Jul. 21, 2005

(86) PCT No.: PCT/US2005/025871

§ 371 (c)(1),
(2), (4) Date: Jun. 27, 2007

(87) PCT Pub. No.: WO2006/012410

PCT Pub. Date: Feb. 2, 2006

(65) Prior Publication Data

US 2008/0040928 A1 Feb. 21, 2008

(30) Foreign Application Priority Data

Jul. 22, 2004 (GB) ..... 0416387.9

(51) Int. Cl.
*B26B 19/02* (2006.01)

(52) U.S. Cl. ..... 30/43.91; 30/43.92; 30/42

(58) Field of Classification Search ..... 30/43.91–46, 30/34.1, 346.51

See application file for complete search history.

(56) References Cited

U.S. PATENT DOCUMENTS

| | | | | | |
|---|---|---|---|---|---|
| 3,156,045 | A | * | 11/1964 | Godefroy | 30/43.3 |
| 4,174,569 | A | * | 11/1979 | Schenk et al. | 30/43.3 |
| 5,632,087 | A | * | 5/1997 | Motohashi et al. | 30/43.92 |
| 5,921,134 | A | * | 7/1999 | Shiba et al. | 74/110 |
| 6,223,438 | B1 | | 5/2001 | Parsonage et al. | |

FOREIGN PATENT DOCUMENTS

| | | |
|---|---|---|
| GB | 1 541 658 | 3/1979 |
| WO | WO 98/01265 | 1/1998 |
| WO | WO 2006/012410 | 2/2006 |

OTHER PUBLICATIONS

PCT International Search Report and Written Opinion dated Jul. 21, 2005, 10 pages.

* cited by examiner

*Primary Examiner*—Boyer D Ashley
*Assistant Examiner*—Omar Flores-Sánchez
(74) *Attorney, Agent, or Firm*—Joanne N. Pappas; Kevin C. Johnson; Steven W. Miller

(57) ABSTRACT

A shaving apparatus comprising a first shaving unit, including a first outer cutter (101,102) and a first undercutter (20) which cooperate together, a skin agitation member (12), a housing and a drive source (58) mounted in the housing. The outer cutter is mounted in a frame (10). The drive source is coupled to the first undercutter to provide oscillatory movement with respect to the frame at a frequency in the range 70 to 280 Hz. The drive source is also coupled to the skin agitation member to provide oscillatory movement at a frequency in the range 5 to 50 Hz. The first outer cutter is un-driven with respect to the frame.

13 Claims, 5 Drawing Sheets

SHAVING APPARATUS

The present invention relates to dry shaving apparatus comprising: a drive source provided in a housing; at least one shaving unit having an outer cutter and an undercutter mounted for relative movement therebetween; and a skin agitation member mounted adjacent to the shaving unit. The invention also relates to a method of shaving.

Although this specification is primarily concerned with shavers having shaving units extending in a longitudinal direction provided with linearly oscillating inner cutters as described in U.S. Pat. No. 5,185,926 (Locke) or U.S. Pat. No. 5,398,412 (Tanahashi et al.), it will be understood that the principles described may also be readily applied in dry shavers provided with rotating inner cutters as known by Japanese patent publication JP-A-5,317,535 (Yamashita) or WO 96/02368 (Sterk et al.).

In addition this application is also concerned with dry shaving apparatus provided with at least one shaving unit and a skin agitation member being fixedly mounted on a shaver housing—U.S. Pat. No. 5,185,926 (Locke)—or mounted floatably in a shear head frame—DE 43 13 371 C2 (Tanahashi et al.)—or mounted in a shear head being pivotably mounted on a shaver housing—WO93/12916 (Wetzel et al.).

Although foil type dry shaving apparatus operates very effectively to remove stubble, problems sometime arise with hairs of a length representing two or three days beard growth. Such hairs no longer readily penetrate through the apertures of the foil and therefore are not cut by the interaction between the undercutter and the foil. Various attempts have been made over the years to combat this problem. For example, U.S. Pat. No. 2,309,431 (Alexay) discloses a dry shaver having a pair of shaving units in which not only the undercutters but also the outer skin-engaging cutters are caused to oscillate in anti-phase. By thus moving the cutting heads on the skin, the hair receiving openings were intended to move over the skin surface with a "scanning" action, so that all parts of the skin beneath the cutting head would be successively brought into register with the hair receiving openings. However, to avoid excessive discomfort it was considered inadvisable to reciprocate the outer cutting heads at more than 3,000 revolutions per minute (50 Hz), although the undercutters were caused to reciprocate at from 3 to 5 times that frequency. Moreover, making use of a somewhat complex cam operated drive assembly, the outer cutters were reciprocated in opposite directions which produces a stationary skin zone mid-way between the cutters. This zone was occupied by a stationary guide plate.

GB Patent 714,863 (Peterson) discloses a device with two outer cutters and a single undercutter. Of the two outer cutters, one may be stationary whilst the other is reciprocated at a slower rate than the single undercutter.

U.S. Pat. No. 5,398,412 (Tanahashi et al.), U.S. Pat. No. 5,704,126 (Franke et al.) and GB Patent 1,367,445 (Sunbeam Corporation) all disclose similar devices which comprise two cutting heads with a third cutting head positioned between them. The outer cutters of each of the three cutting heads are stationary with only the undercutters being reciprocated.

U.S. Pat. No. 4,174,569 (Schenk et al.) and U.S. Pat. No. 3,156,045 (Godefroy) disclose similar proposals to each other in which a single outer shearing cutter is caused to oscillate in contact with the skin, whilst an undercutter oscillates beneath the outer cutter. As in U.S. Pat. No. 2,309,431 (Alexay), the frequency of oscillation of the undercutter is considerably higher than that of the outer cutter although no specific values are given for these frequencies.

In the same manner, International Patent Applications WO 98/01264 and WO 98/01265 (both Parsonage et al.) disclose a dry shaver apparatus having at least one shaving unit acting as short hair cutter situated adjacent a long hair cutter. The short hair cutter is provided with a fixed outer cutter or foil and a driven undercutter. The long hair cutter is provided with a driven outer cutter and a driven undercutter. This long hair cutter may operate as a skin agitation member by activating the skin surface so that it moves to and fro across the skin-engaging surface of the adjacent short hair cutter. This action aids penetration of the hairs into the short hair cutter and minimises the likelihood of discomfort. Separate drives are provided so that the short hair undercutter and the long hair undercutter may be driven together, with the long hair outer cutter driven separately. However, there is no discussion of particular ratios of frequency at which the undercutters and outer cutters are respectively driven. Nor is there any mention of the effect these ratios of different frequencies may have.

It is an object of the invention to provide a dry shaving apparatus which effectively removes short and long hairs. It is a further object of the invention to provide a skin agitation member which feeds hairs into the short hair cutters.

In one aspect of the invention there is provided a shaving apparatus comprising a first shaving unit including a first outer cutter and a first undercutter cooperating together wherein said outer cutter is mounted in a frame, a skin agitation member, a housing and a drive source mounted in said housing and coupled with said first undercutter to provide oscillatory movement with respect to said frame of said first undercutter in response thereto at a frequency in the range 70 to 280 Hz, and being coupled to said skin agitation member to provide oscillatory movement of said skin agitation member at a frequency in the range 5 to 50 Hz, said first outer cutter being static with respect to said frame.

In the construction described above, the first outer cutter is fixed relative to the frame in which it is mounted, and thus static or undriven. Conversely, the associated first undercutter is driven so that it oscillates with respect to the outer cutter and frame. However, the frame and undercutter may also be driven, in an oscillatory or other manner, with respect to the housing in which the drive source is mounted.

According to another aspect of the invention, there is provided a method of shaving in which the skin is agitated by an agitation member oscillating at a frequency in the range 5 to 50 Hz and is simultaneously shared by a shaving unit having a static outer cutter and an undercutter oscillating at a frequency in the range 70 to 280 Hz.

Further embodiments are disclosed in the dependent claims attached hereto.

The present invention and its advantages will be better understood by referring, by way of example, to the following detailed description and the attached Figures, in which.

Figure 1:
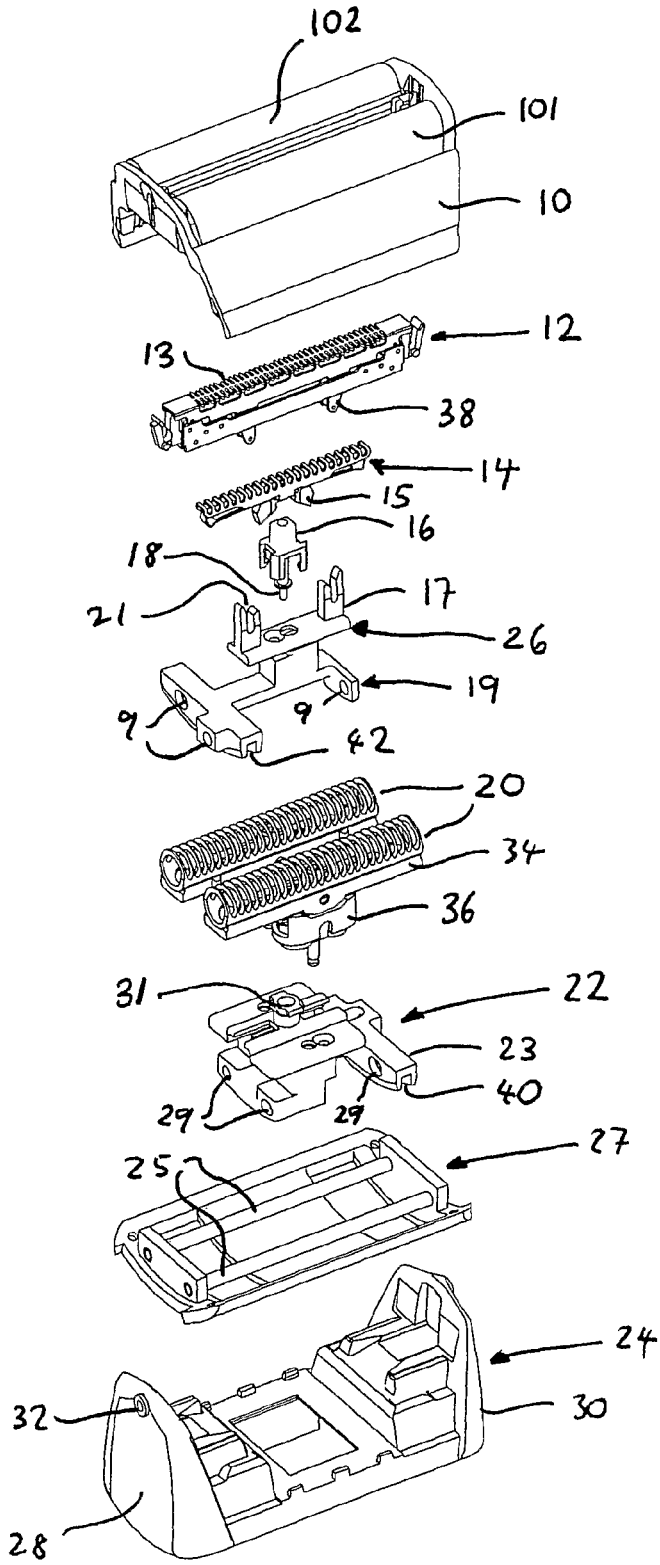
FIG. 1 shows an exploded isometric view of the shaving apparatus according to one embodiment of the invention.

FIG. 1 represents one embodiment of the shaving apparatus assembled from nine separate modules: a foil frame assembly 10, a long hair outer cutter sub-assembly 12 also functioning as a skin agitation assembly, a long hair undercutter 14, a long hair undercutter drive latch 16, a low speed drive coupling 26, short hair undercutters 20, a high speed drive coupling 22, a drive cover 27 and a chassis module 24.

The foil frame assembly 10 comprises two short hair outer cutters 101, 102 mounted in a frame such that they can move vertically but not axially. In the illustrated embodiment, these outer cutters are conventional shaving foils.

Each short hair undercutter 20 comprises a generally tubular member, as shown in FIG. 1, provided with a plurality of transverse slots to provide a plurality of arcuate blades which cooperate in a shearing action during shaving with the corresponding outer cutter or foil 101, 102, to which it is positively biased. Each cutter member is mounted on a support 34. This support 34 is pivotably connected to a bearing block 36. Motion is transmitted to the undercutters, as discussed below, from the high speed drive coupling 22 on which the support can rotate and move laterally to ensure effective cutter contact with the foil outer cutter.

In the illustrated embodiment, the skin agitation assembly 12 comprises a long hair outer cutter 13 and an undercutter 14. The long hair undercutter 14 is coupled to an undercutter drive latch 16, which engages between lugs 15, and may be positively biased towards the outer cutter 13 to ensure greater cutting efficiency. This drive latch 16 is connected to the high speed drive coupling 22 by means of a cutter drive pin 18 which engages in a boss 31 on the upper side of the high speed drive coupling 22. Moreover, the short hair undercutters 20 are mounted on the high speed drive coupling 22, which includes a slider 23. This slider has guide bores 29. These bores fit over guides 25 which form part of the drive cover 27 enabling the high speed drive to slide in a reciprocating manner back and forth, without undue vertical movement, when driven. At the base of the slider 23, a groove 40 is formed. This groove interacts with a drive mechanism which is described in more detail below.

Returning now to the long hair outer cutter 13, this is driven by the separate low speed drive coupling 26. This low speed drive coupling has two arms 17 each with a corresponding slot 21 at their ends. Two drive tabs 38 are located on the underside of the long hair outer cutter sub-assembly 12. These drive tabs 38 engage into corresponding ones of the slots 21 located on the arms 17.

The low speed drive coupling 26 is connected to a slider 19. This slider has guide bores 9 which fit over the guides 25 forming part of the drive cover 27 as described above. The guides 25 hold the slider 19 in place so that the low speed drive may slide in a reciprocating manner back and forth, without undue vertical movement, when driven. At the base of the slider 19 is a groove 42. This groove interacts with the drive mechanism which is described in more detail below.

The chassis module 24 is arranged to pivot about two axial stubs (not shown) which engage in bearing apertures in the respective end plates 28, 30. One such bearing aperture 32 is shown in end plate 28. It may be seen that the base of the chassis module 24 is curved. This is to permit the shaving head to pivot about the two axial stubs without interference from the main body of the shaving apparatus. Further, the bases of the sliders 19, 23 are also curved in a similar manner to that of the base of the chassis module 24. The grooves 40, 42 formed in these bases are also curved. The grooves 40, 42, both extend in an arc centered about the bearing apertures. Further details of this are discussed below.

Figure 2:
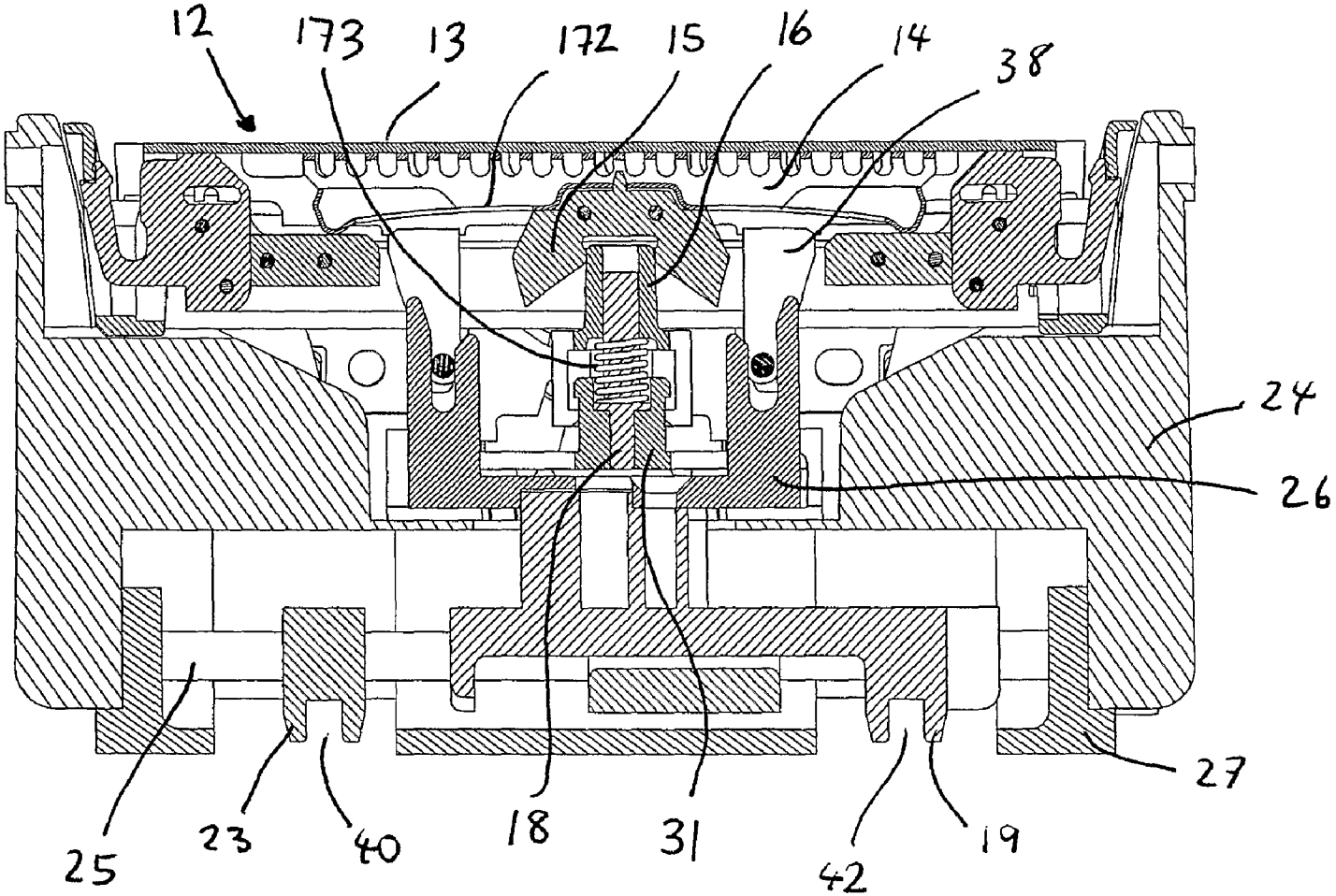
FIG. 2 shows an orthographic cross section of a shaver head of the embodiment of FIG. 1.

FIG. 2 is an orthographic cross-section of the shaver of FIG. 1. The long hair outer cutter 13 and undercutter 14 are visible. The drive latch 16 which transmits motion to the long hair undercutter 14 may be seen between the drive tabs 38. These tabs 38 transmit motion to the outer cutter 13 as explained below.

In the illustrated embodiment it may thus be seen that the two cutters 13,14 of the long hair cutting unit 12 are driven separately. The undercutter 14 is driven by the high speed drive coupling 22, whilst the outer cutter 13 is driven by the low speed drive coupling 26 via the drive tabs 38. A leaf spring 172 biases the undercutter 14 against the outer cutter 13. A further spring 173 provides a resilient mounting for the long hair cutter assembly, and permits a degree of vertical or "floating" movement.

Figure 3:
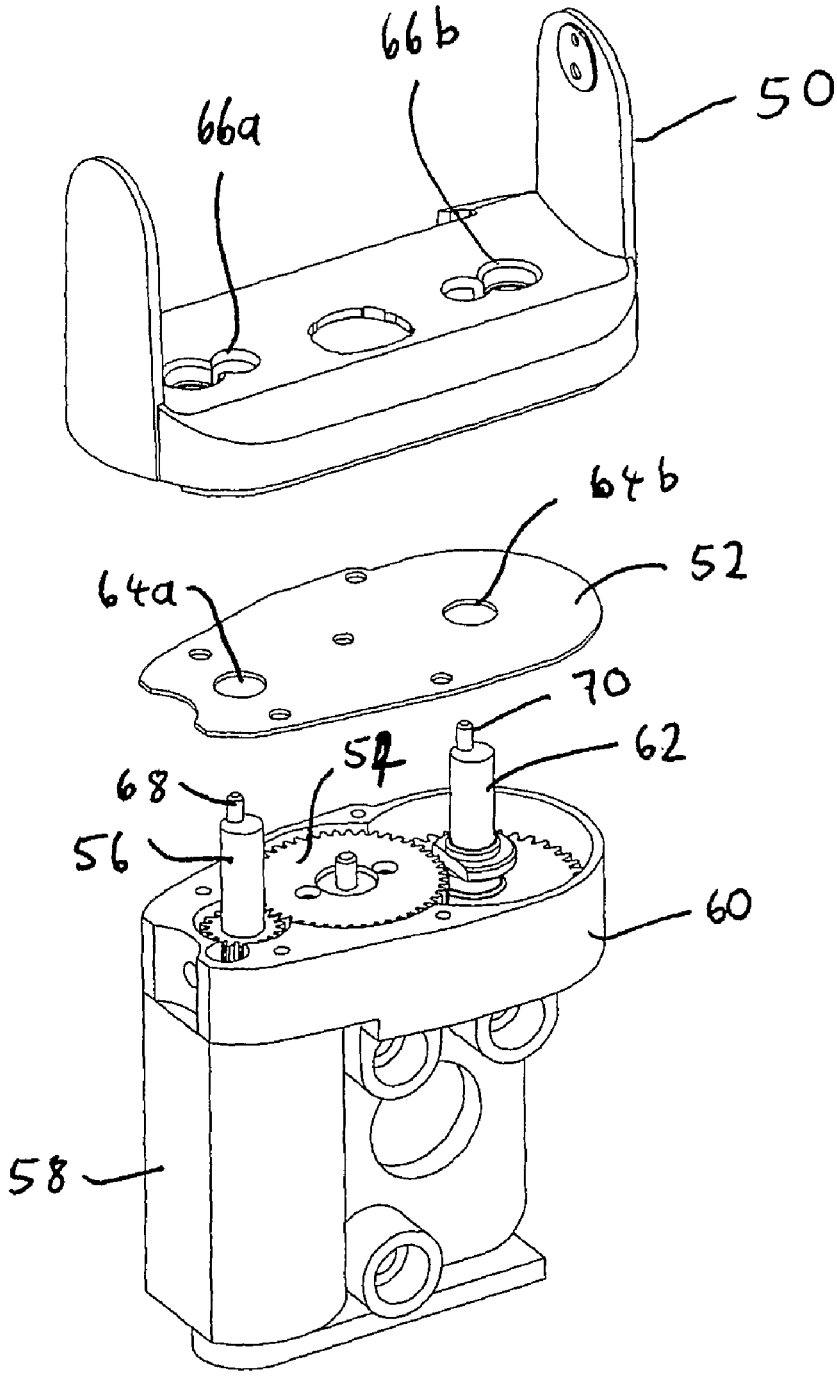
FIG. 3 shows a partial exploded isometric view of a drive system for the shaver head.

FIG. 3 is an exploded view of the drive mechanism. This mechanism comprises a motor 58 which directly drives a high speed shaft 56. At the end of the shaft 56 a pin 68 is eccentrically positioned. The shaft 56 passes through holes 64*a* and 66*a* provided in the gearbox cover 52 and the base of the yoke 50 respectively. The pin 68 engages in the groove 40 on the base of the slider 23 described above with reference to FIG. 1. By rotation of the pin, the groove 40 and hence the slider 23 reciprocate back and forth along the guides 25. This movement is then transmitted to the long hair undercutter 14 as described above, so that it also reciprocates. Further, the high speed drive coupling 22 also connects to the bearing block 36 which in turn is connected to the short hair undercutters 20. Thus the short hair undercutters 20 are also driven by the high speed drive coupling 22.

Also shown in FIG. 3 is an input gear wheel 54. This is driven from the high speed drive shaft 56 and in turn rotates a low speed drive shaft 62. The speed of rotation is reduced so that the low speed drive shaft rotates at a slower speed than the high speed drive shaft. This is effected by means of gearing as may be generally seen in the gear box body 60.

At the end of the low speed drive shaft 62 is another pin 70. This is also placed eccentrically with respect to the axis of the shaft. The shaft 62 passes through holes in the gearbox cover 52 and the base of the yoke 50. The pin 70 engages in the groove 42 found on the base of the slider 19. As the pin 70 rotates it urges the slider 19 to move back and forth along the guides 25. Since the slider 19 is connected to the low speed drive coupling 26, as discussed above with reference to FIG. 1, the low speed drive coupling 26 also reciprocates back and forth. This motion is then transmitted to the long hair outer cutter 13 via arms 17, slots 21 and drive tabs 38, as discussed above, so that it also moves in a reciprocating manner.

As discussed above with reference to FIG. 1, the bases of the two sliders 19 and 23 and the grooves 40, 42 formed within them are curved. Accordingly, when the shaving head is pivoted about the bearing apertures 32, the pins 68, 70 which remain stationary with respect to the shaving head, will remain in contact with these sliders and thus ensure that the reciprocating motion is not interrupted by the pivoting of the head.

In the illustrated embodiment the long hair undercutter 14 is driven separately from the long hair outer cutter 13. This allows the cutters to be driven at different speeds.

Figure 4:
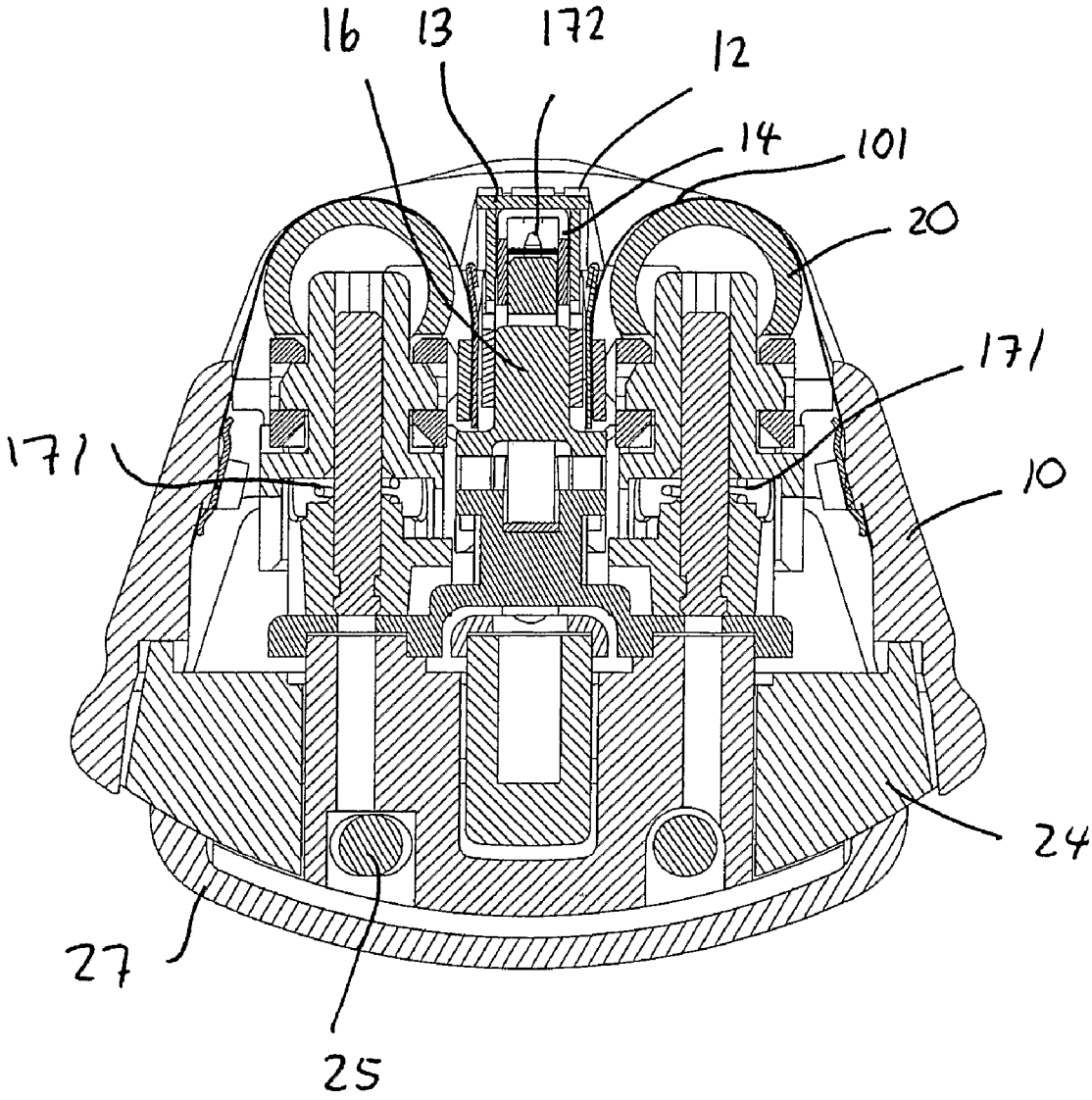
FIG. 4 shows a cross-section through the centre line of the shaver head of FIG. 2.

FIG. 4 shows a cross-section through the centre line of an assembled shaving head. The curved shape of the base of this head may be clearly seen. Further, the guide rods 25 may also be clearly seen towards the base of the head. Also visible are the short hair undercutters 20, the short hair outer cutters 101, the long hair outer cutter 13 and the corresponding long hair undercutter 14. The foil frame assembly 10 may be seen in its typical position assembled with the chassis module 24.

Springs 171 are located within the apparatus to positively bias the short hair undercutters towards their respective outer cutters (or foils), and spring 172 to positively bias the long hair undercutter towards the long hair outer cutter.

Figure 5:
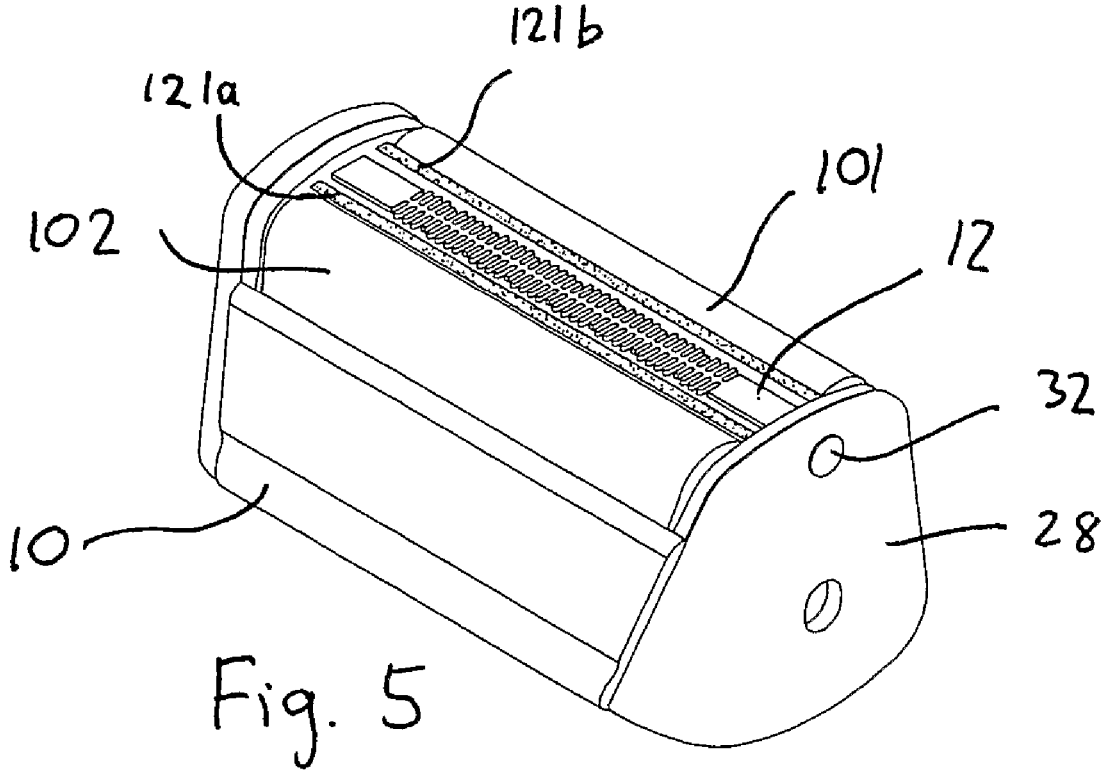
FIG. 5 shows a swivel head frame for a triple-headed shaver, in which a central long hair cutter unit is positioned between adjacent short hair cutter units.

A swivel head frame for a triple-headed shaver arrangement is shown in FIG. 5, in which a central long hair cutter unit 12 is positioned between adjacent short hair cutter units 101, 102. An end plate 28 including one bearing aperture 32 is shown fitting over the end of the head. Further the foil frame assembly is shown in its typical position fitted over the chassis module 24, which itself cannot be seen due to the presence of the foil frame assembly 10 and end plate 28. This embodiment also includes skin-contacting members 121*a*,121*b* positioned on each side of the central long-hair cutter 12. In this embodiment, the skin-contacting members 121*a*,121*b* could be driven together with the outer cutter 13 of the long hair cutter unit 12. Alternatively, the outer cutter 13 could be static, and the slow-speed drive coupled only to the skin contacting member 121*a*,121*b*.

In this embodiment the long hair cutting unit 12 is situated between two short hair cutting units 101,102. However, in another embodiment there may be only one short hair cutting unit with an adjacent long hair cutting unit.

In the embodiment shown in the Figures it has already been described how the long hair outer cutter may be driven separately from both the long hair undercutter and the short hair undercutters. This feature allows the frequency of the long hair outer cutter to be lower than that of the undercutters. Such a frequency for this long hair outer cutter may lie in the range 5 to 50 Hz. More particularly, this range may lie between 6 and 28 Hz. A particularly preferred frequency is 12 Hz.

Experimentation has shown that a frequency of 12 Hz, when combined with undercutters driven at a relatively high frequency, improves the feeding of long hairs through the foil of the adjacent short hair cutters.

The improved hair feeding provided by the long hair outer cutter is related to the ratio of frequencies of the long hair outer cutter and the adjacent short hair undercutters. It has been found that such a desirable ratio is one in which the long hair outer cutter is driven at a frequency an order of magnitude less than the frequency of the adjacent short hair undercutters. As has been stated, the frequency of the long hair outer cutter lies in a range between 5 and 50 Hz. More particularly, this range may lie between 6 and 28 Hz, and most preferably 12 Hz. Accordingly, the frequency of the short hair undercutters should lie in the range 70 to 280 Hz.

Both the short hair and long hair undercutters may be driven by a single drive. However, the short hair undercutters may also be driven separately from the long hair undercutter. The short hair outer cutters are un-driven and therefore static with respect to the frame in which they are mounted.

The outer surface of the long hair outer cutter which is in contact with the user's face has an inherent coefficient of friction. However, by using different materials to manufacture the outer cutter, or by finishing the outer surface in different ways, for example with different textures, or even by the addition of a different material adhered to the outer surface, this coefficient of friction may be altered.

A higher coefficient of friction will cause the skin to move more readily and thus facilitate the feeding of hairs into the adjacent short hair cutters, and thus improve the closeness of the shave. However, such a high coefficient may also increase the discomfort to the user.

It has been found that by reducing the amplitude of the cutters the coefficient of friction may be correspondingly increased without an increase in discomfort. However, reducing the amplitude may have a detrimental effect on the closeness and efficiency of the shave. Consequently, a balance is preferably struck between discomfort and efficiency by the careful choosing of amplitude and coefficient of friction.

With regard to amplitude, this term takes its usual meaning in that it specifies half the total displacement of the oscillating object during its motion. For the present invention the amplitude of the short hair undercutters may be in the range 0.8 to 1.8 mm. More preferably the amplitude is 1.2 mm. For the long hair outer cutter the amplitude may lie in the range 0.3 to 1.5 mm. More preferably the amplitude is 0.6 mm.

It should be noted that the construction of the shaving apparatus may include a short hair cutter situated either side of the long hair cutter. This would improve the efficiency of the shave in that long hairs would be fed into the short hair cutters when the shaver was operated in either direction. In other words this feeding of long hairs would occur with bi-directional shaving motion. However, it is possible to have a construction where the long hair cutter is situated to the side of two short hair cutters. Further, a construction having three short hair cutters evenly interspaced with two long hair cutters is conceived.

Figure 6:
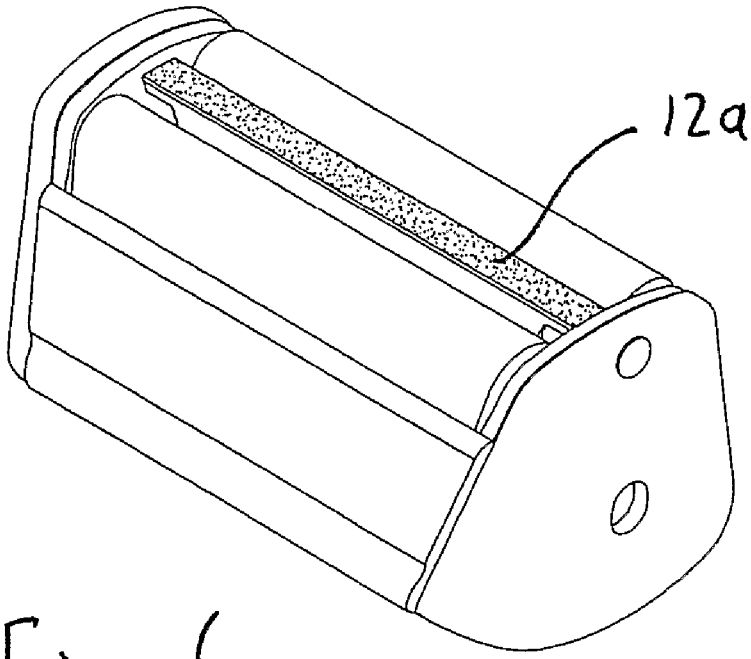
FIG. 6 shows a swivel head frame for a shaver in which a skin contacting member is positioned between adjacent short hair cutter units.

FIG. 6 shows an alternative construction comprising a skin contacting member 12*a* in place of the long hair cutter. The skin contacting member is driven in the same manner as the long hair outer cutter. However, no long hair undercutter is provided. The skin contacting member may be driven in the same frequency range as the long hair outer cutter, 5 to 50 Hz, and acts to agitate the skin.

This skin contacting member 12*a* of FIG. 6 and also the members 121*a*, 121*b* of FIG. 5 may have the coefficient of friction of the outer surface varied in the same manner as described for the long hair outer cutter. Preferably the skin contacting members may be made of metal. Alternatively, other materials could be used such as elastomer. The surface finish of the skin contacting members may also be knurled or roughened for example. In FIGS. 5 and 6, the surface of the skin contacting members 12*a*, 101*a* and 101*b* is slightly roughened.

With regard to the drive mechanism and the associated gear reduction assembly, it is possible to have two motors instead of just one. The first would drive at one speed with the other driving at a different speed. For instance, in one embodiment, one motor could drive the high speed drive coupling, as described above with reference to FIGS. 1 and 3, whilst the other would drive the low speed drive coupling. Such an arrangement would remove the necessity for a gear reduction mechanism.

A further construction is also envisaged in which instead of one or more motor, solenoids are employed. Solenoids, as is well known, produce a linear movement as opposed to the rotary movement which motors produce. This linear movement could be used to drive the various cutters directly without the need for some of the components described above with regard to FIG. 3, for instance the eccentrically placed pins 68, 70.

Further still, although with reference to the Figures, a swivel headed shaving apparatus has been described, a fixed head shaving apparatus is envisaged. Such an apparatus would not require the grooves 40, 42 which allow transfer of the eccentric rotational motion of the pins 68, 70 to lateral movement (thus driving the sliders 19, 23 and the drive couplings 22, 26) whatever position the shaving head is in relative to the body of the apparatus.

The following reference numbers, included in the specification, have the meaning as listed below:

REFERENCE NO. MEANING

09 guide bore
10 frame assembly
12 long hair cutter unit
12*a* skin contacting member
13 long hair outer cutter
14 long hair undercutter
15 drive lug
16 long hair undercutter drive coupling
17 arms
18 long hair cutter drive pin
19 slider
20 short hair undercutter
21 slot
22 high speed drive coupling
23 slider
24 chassis module
25 guide
26 low speed drive coupling
27 drive cover
28, 30 end plates
29 guide slot
31 boss on high speed coupling
32 bearing aperture
34 support
36 bearing block
38 drive tab
40 groove
42 groove
50 yoke
52 gearbox cover
54 input gearwheel
56 high speed drive shaft
58 motor
60 gear box body
62 low speed drive shaft
64*a* hole
66*a* hole
68 pin
70 pin
101, 102 short hair outer cutters
121 *a*, 121*b* skin contacting members
171,172,173 bias springs

The invention claimed is:

1. A shaving apparatus comprising:

a first shaving unit including a first outer cutter (101,102) and a first undercutter (20) cooperating together wherein said outer cutter is mounted in a frame (10);

a skin agitation member;

a housing; and a driving source (58) mounted in said housing and coupled with said first undercutter to provide oscillatory movement with respect to said frame of said first undercutter in response thereto at a frequency in the range 70 to 280 Hz, and being coupled to said skin agitation member to provide oscillatory movement of said skin agitation member at a frequency in the range 5 to 50 Hz, said first outer cutter being static with respect to said frame, wherein said drive source is connected directly to said short hair undercutters and indirectly to said skin agitation member via gearing.

2. Apparatus according to claim 1, wherein the frequency of said first undercutter is an order of magnitude higher than the frequency of said skin agitation member.

3. Apparatus according to claim 1 or 2, wherein said skin agitation member comprises an outer cutter (13) of a long hair cutting unit (12), and cooperates with a second undercutter (14).

4. Apparatus according to claim 3, wherein said second undercutter is coupled to said drive source for driving at a frequency in the range of 70 to 280 Hz.

5. Apparatus according to claim 3, wherein said undercutters are all coupled to the drive system for driving at the same frequency.

6. Apparatus according to claim 1, further comprising an additional shaving unit located adjacent the skin agitation member on the opposite side from the first shaving unit and having a second outer cutter (101, 102) and an additional undercutter (20), wherein said second outer cutter is mounted in said frame and said additional undercutter is coupled to the drive source for providing oscillatory movement thereto with respect to said frame, said second outer cutter being static with respect to said frame.

7. Apparatus according to claim 6, wherein the undercutter of said additional shaving unit is coupled to the drive source to be driven at a frequency in the range of 70 to 280 Hz.

8. Apparatus according to claim 1, in which the skin agitation member is coupled to the drive source via gearing (60).

9. Apparatus according to claim 1, in which the skin agitation member is mounted for oscillating movement in a direction parallel to the direction of oscillation of said first undercutter.

10. Apparatus according to claim 1, in which the drive source (58) is coupled to the skin agitation member to provide oscillation at a frequency in the range 6 to 28 Hz.

11. Apparatus according to claim 10, in which the drive source (58) is coupled to the skin agitation member to provide oscillation at substantially a frequency of 12 Hz.

12. Apparatus according to claim 1, wherein said, drive source is connected to said short hair undercutters via an eccentrically rotated pin (68) interacting with a high speed drive coupling (22).

13. Apparatus according to claim 1, wherein said drive source is connected to said skin agitation member via an eccentrically rotated pin (70) interacting with a low speed drive coupling (26).

* * * * *